US009498691B2

(12) United States Patent
Antoine

(10) Patent No.: US 9,498,691 B2
(45) Date of Patent: Nov. 22, 2016

(54) TRAINING APPARATUS FOR ATHLETES AND OTHERS

(71) Applicant: Justin Douglas Antoine, Oakville (CA)

(72) Inventor: Justin Douglas Antoine, Oakville (CA)

( * ) Notice: Subject to any disclaimer, the term of this patent is extended or adjusted under 35 U.S.C. 154(b) by 0 days.

(21) Appl. No.: 14/595,381

(22) Filed: Jan. 13, 2015

(65) Prior Publication Data

US 2015/0202512 A1 Jul. 23, 2015

Related U.S. Application Data

(63) Continuation-in-part of application No. 14/157,589, filed on Jan. 17, 2014, now abandoned.

(51) Int. Cl.

| | |
|---|---|
| ***A63B 21/00*** | (2006.01) |
| ***A63B 21/02*** | (2006.01) |
| ***A63B 69/00*** | (2006.01) |
| ***A63B 21/04*** | (2006.01) |
| ***A63B 21/055*** | (2006.01) |

(52) U.S. Cl.

CPC ..... *A63B 69/0022* (2013.01); *A63B 21/00061* (2013.01); *A63B 21/0421* (2013.01); *A63B 21/0552* (2013.01); *A63B 21/4009* (2015.10); *A63B 21/4011* (2015.10); *A63B 21/4015* (2015.10); *A63B 21/4025* (2015.10); *A63B 69/0026* (2013.01); *A63B 2209/10* (2013.01); *A63B 2244/18* (2013.01)

(58) Field of Classification Search

CPC ..... A63B 21/04; A63B 21/0407; A63B 21/0414; A63B 21/055; A63B 21/151; A63B 69/0022; A63B 69/0026; A63B 21/02; A63B 21/0552; A63B 21/0557

See application file for complete search history.

(56) References Cited

U.S. PATENT DOCUMENTS

| | | | | |
|---|---|---|---|---|
| 3,928,872 | A | 12/1975 | Johnson | |
| 4,509,921 | A | 4/1985 | Buchheister et al. | |
| 4,632,217 | A | 12/1986 | Markwell et al. | |
| 4,685,671 | A | 8/1987 | Hagerman et al. | |
| 4,922,860 | A | 5/1990 | Hutchings | |
| 5,062,642 | A | 11/1991 | Berry et al. | |
| 5,131,685 | A | 7/1992 | Dandy, III et al. | |
| 5,136,727 | A | 8/1992 | Brisco | |
| 5,172,703 | A | 12/1992 | Tiede et al. | |
| 5,201,074 | A | 4/1993 | Dicker | |
| 5,203,754 | A * | 4/1993 | Maclean | A63B 21/0004 482/121 |
| 5,252,112 | A | 10/1993 | Shibaoka et al. | |
| 5,256,119 | A | 10/1993 | Tudor | |
| 5,306,222 | A | 4/1994 | Wilkinson | |
| 5,308,305 | A * | 5/1994 | Romney | A63B 21/4025 2/69 |
| 5,465,428 | A | 11/1995 | Earl | |
| 5,653,467 | A | 8/1997 | Griffin et al. | |

(Continued)

*Primary Examiner* — Oren Ginsberg
*Assistant Examiner* — Nyca T Nguyen
(74) *Attorney, Agent, or Firm* — Bejin Bieneman PLC

(57) ABSTRACT

A training apparatus particularly suited for ice skaters. The training apparatus includes a cover, typically formed as shorts sized to be worn over traditional hockey pants or a hockey girdle, and one or more connectors. The connectors are attached to the cover in fixed positions around the upper leg and buttocks of the user of the training apparatus, and slidably and releasably receive through looped parts at least one elongate, flexible, elastic resistive member to provide resistance against the motion of a user while engaging in physical activities, such as skating. The connectors are mounted on both the front and back of the cover and include upper connectors mounted on an upper tubular section of the cover and lower connectors mounted on the front of leg sections of the cover.

6 Claims, 7 Drawing Sheets

(56) References Cited

U.S. PATENT DOCUMENTS

| | | | | |
|---|---|---|---|---|
| 5,727,254 | A | 3/1998 | Dicker | |
| 5,737,772 | A | 4/1998 | Dicker et al. | |
| 5,819,322 | A | 10/1998 | Dicker et al. | |
| 5,829,058 | A | 11/1998 | Dicker et al. | |
| 5,857,947 | A | 1/1999 | Dicker et al. | |
| 6,099,446 | A | 8/2000 | Johnson et al. | |
| 6,176,816 | B1 | 1/2001 | Dicker et al. | |
| 6,179,760 | B1 | 1/2001 | Rumbaugh | |
| D457,965 | S * | 5/2002 | Firer | D24/190 |
| 6,551,221 | B1 * | 4/2003 | Marco | A63B 21/0004 280/600 |
| 6,702,328 | B2 | 3/2004 | Malleis et al. | |
| 6,732,834 | B2 | 5/2004 | Colorado | |
| 6,837,834 | B2 | 1/2005 | Basting | |
| 6,875,135 | B2 | 4/2005 | Tracy, Sr. | |
| 7,261,679 | B2 | 8/2007 | Sload | |
| 7,654,921 | B2 | 2/2010 | Brunst | |
| 7,730,552 | B2 | 6/2010 | Ota et al. | |
| 7,931,571 | B2 | 4/2011 | Bernardoni | |
| 8,060,945 | B2 | 11/2011 | Adarrage | |
| 8,407,814 | B2 | 4/2013 | Caillibotte et al. | |
| 2003/0092545 | A1 * | 5/2003 | Koscielny | A61H 1/02 482/124 |
| 2003/0130098 | A1 | 7/2003 | Marco | |
| 2006/0040807 | A1 | 2/2006 | Miller | |
| 2006/0113787 | A1 | 6/2006 | Siebrecht | |
| 2006/0183609 | A1 | 8/2006 | Flynn | |
| 2007/0004571 | A1 * | 1/2007 | Gonzalez | A63B 21/4025 482/124 |
| 2007/0027419 | A1 | 2/2007 | Drennan | |
| 2007/0213186 | A1 | 9/2007 | Longo | |
| 2007/0287616 | A1 * | 12/2007 | Weaver | A63B 21/0004 482/124 |
| 2008/0287840 | A1 | 11/2008 | Koscielny et al. | |
| 2010/0041527 | A1 | 2/2010 | Miller | |
| 2010/0043114 | A1 | 2/2010 | Caillibotte et al. | |
| 2010/0088803 | A1 | 4/2010 | Orloff | |
| 2011/0111890 | A1 | 5/2011 | Webb et al. | |
| 2011/0111932 | A1 | 5/2011 | von Hoffmann et al. | |
| 2011/0247127 | A1 | 10/2011 | Pou et al. | |
| 2012/0156962 | A1 | 6/2012 | Krawchuk | |
| 2012/0270708 | A1 | 10/2012 | Paulos | |
| 2013/0045842 | A1 | 2/2013 | Wood | |
| 2013/0079201 | A1 | 3/2013 | Morgan | |
| 2013/0150218 | A1 | 6/2013 | Mial | |
| 2013/0167285 | A1 | 7/2013 | Decker | |

* cited by examiner

TRAINING APPARATUS FOR ATHLETES AND OTHERS

CROSS-REFERENCE TO RELATED APPLICATION

This application claims priority to and is a continuation in part of U.S. application Ser. No. 14/157,589 filed on Jan. 17, 2014, which application is hereby incorporated by reference in its entirety.

FIELD

The present invention relates to a training apparatus, and in particular to a wearable apparatus for providing resistance while engaging in athletic activities.

BACKGROUND

Resistance bands or tubing are used as an alternative to free weights or weight machines for resistance training of muscle groups. Resistance tubing has been used with a harness device to allow a user to progress through natural motions, such as walking, running or jumping, while subjected to the resistance offered by the tubing.

Published U.S. patent application 2003/0130098 describes a training device for training a gliding sport athlete such as a skater, this device including a belt that is secured about the waist of the athlete. The belt has a front portion adapted to be worn adjacent the navel area and left and right side portions to be worn adjacent the right and left hips. A pair of foot attachments are adapted to be fastened to front portions of the athlete's feet or footwear. The device includes a first pair of cords having one end of each cord connected to the belt and another end connected to one of the foot attachments so as to position the first pair of cords on each side of the right knee of the athlete when in use. There is also a second pair of cords having one end connected to the belt and another end connected to another of the foot attachments so as to position the second pair of cords on each side of left knee of the athlete. Each of the cords has an unstretched length less than a length between the athlete's waist and his or her feet.

It is also known to provide a similar training device for walkers and runners, this device also employing a harness mounted around the waist of the user to which resistance tubes can be attached. The ends of the tubes are attached to the footwear of the user, for example, to the user's running shoes.

U.S. Pat. No. 6,179,760 dated Jan. 30, 2001 describes an exercise device for assisting a rider's leg muscles during cycling. Elastic members are worn on the legs such that the elastic members will stretch on the downstroke of the pedals and will contract on the upstroke to release energy and thereby assist the legs to rotate the pedals. The elastic members can be attached to a waist member worn about the waist of the cyclist.

Despite these known training devices and mechanisms, including other well known training machines, there is a need for an improved training apparatus to develop the legs of athletes, particularly those of skaters and hockey players. There is a particular need for such training apparatus that can be manufactured at a reasonable cost and that can be used with or can include elongate, elastic resistive members or tubes.

According to one embodiment of the training apparatus of this invention, a training apparatus for skaters comprises a cover made of flexible fabric for wearing over pants or shorts, this cover having a front and a back and including an upper tubular section adapted for extending around a skater's lower body. The cover further includes attached left and right leg sections extending from a bottom end of the upper tubular section and adapted for covering at least upper portions of the skater's legs. Connectors are mounted on both the front and the back of the cover, these connectors including upper connectors mounted on the upper tubular section and lower connectors mounted on a front side of both the left and right leg sections. Each connector includes means for forming an aperture for passage of a flexible resistive member. The apparatus also has two separate, elongate elastic resistive members adapted for attachment to the cover by means of the connectors. Each resistive member is mountable on a respective one of left and right halves of the cover so that, during use of the cover, sections of the respective resistive member extend along opposite sides of a respective leg of the skater to a skate worn by the skater. The training apparatus also includes fastener mechanisms for securing each resistive member to a respective one of the two skates worn by the skater.

In one exemplary version of this apparatus, the connectors are flexible patches and the aperture provided by each of the patches is in the form of a loop part slidably and releasably receiving its respective one of the resistive members.

According to another embodiment of the training apparatus of this invention, a training apparatus for a skater comprises a flexible fabric cover adapted for wearing over pants or shorts and having a front, a back, a top end and a bottom end. The cover includes a main body section and left and right leg sections extending from and connected to the main body section and capable of covering at least upper portions of the skater's legs. Loop-forming connectors are mounted on both the front and the back of the cover. These connectors include upper connectors mounted on the front and back of the main body section and lower connectors mounted on the front side of both the left and right leg sections. Each of the connectors in use forms a loop. Elongate elastomeric resistive members are attachable to the cover by means of the loops formed by the connectors. At least one of these resistive members is detachably mounted on each of the left and right halves of the cover so that, during use of the training apparatus, sections of the at least one resistive member extend along opposite sides of a respective one of the legs of the skater to a skate worn by the skater and are attached to a fastening mechanism on the skate.

In one exemplary version of this apparatus, the connectors are fabric patches and the loop formed by each connector slidably and releasably receives its respective resistive member. Each resistive member can be a stretchable tube member having two opposite ends and a mechanical fastener secured to each of these opposite ends.

According to a further embodiment, a wearable cover for use with elongate, elastomeric resistive members comprises a cover member made of strong, flexible fabric for wearing on a person's lower body, this cover member including an upper tubular section wearable over a lower trunk region of a user's body and left and right leg sections attached to and extending from a bottom end of the upper tubular section and adapted to cover at least upper portions of the user's legs; and a plurality of loop-forming connectors for mounting the resistive members on the cover member, these connectors including at least four upper connectors mounted on both front and back sides of the upper tubular section and four lower connectors mounted on or adjacent a front side of the left and right leg sections. During use of the cover, the resistive members can be mounted on an exterior of the cover member and attached to footwear of the user in order to enhance exercise of the legs of the user.

Further aspects and features will become apparent from the following description of exemplary embodiments taken together with the accompanying drawings.

For a better understanding of the present invention, and to show more clearly how it may be carried into effect, reference will now be made, by way of example, to the accompanying drawings in which:

DETAILED DESCRIPTION

Figure 1:
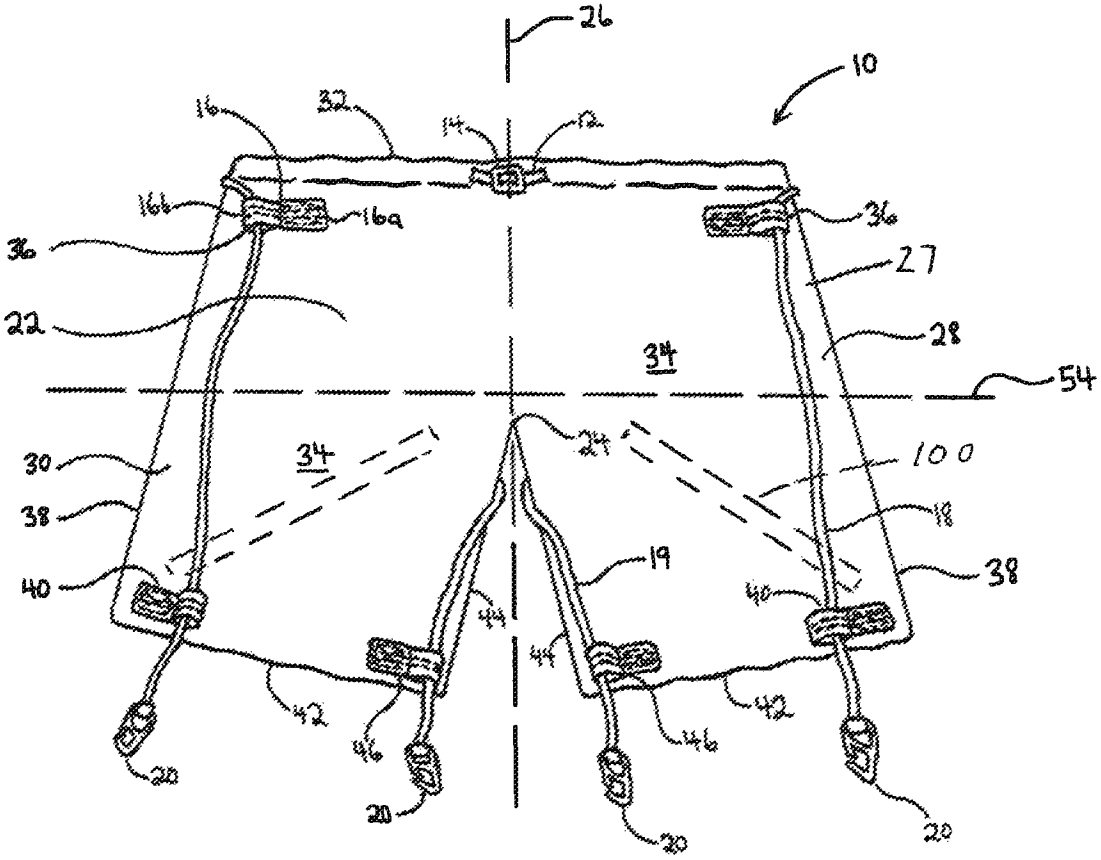
FIG. 1 is a front view of an embodiment of the training apparatus constructed in accordance with the present invention.

The present invention may be embodied in a number of different forms. The specification and drawings that follow describe and disclose some of the specific forms of the invention.

In the accompanying drawings, a training apparatus constructed in accordance with an embodiment of the invention is noted generally by reference numeral 10. The training apparatus 10 is comprised of a shell or cover 22 made of flexible fabric. It is expected that in most embodiments, the cover is formed as a pair of shorts including an upper tubular section 27 adapted for extending around a skater's lower body, a left leg sleeve 28 and a right leg sleeve 30, the shorts sized to be wearable over traditional hockey pants or hockey girdle. It will be appreciated that the cover can also be formed as a pair of pants sized to be wearable over traditional hockey pants or hockey girdle. Further, the cover can be worn over regular clothing to train ice skaters who do not wear hockey gear. In most embodiments, the cover is formed from nylon so that it presents a strong, low-friction surface, but other similar low-friction materials can be used.

One or more connectors which can be in the form of patches 16 are attached to the cover. In most cases it is expected that each connector or patch includes a looped part **16*b*** that forms a loop. In preferred embodiments, the patches are formed from nylon webbing to give them strength and to present a low-friction surface. Other similar low-friction materials of similar strength can be used.

In most cases the patches are fixedly attached to the cover; this can be achieved by reinforced stitching or some other mechanical or adhesive mechanism for fixedly attaching the one or more patches to the cover. In one exemplary embodiment, the patches are dimensioned approximately two inches by two inches, although other sizes are possible.

Figure 2:
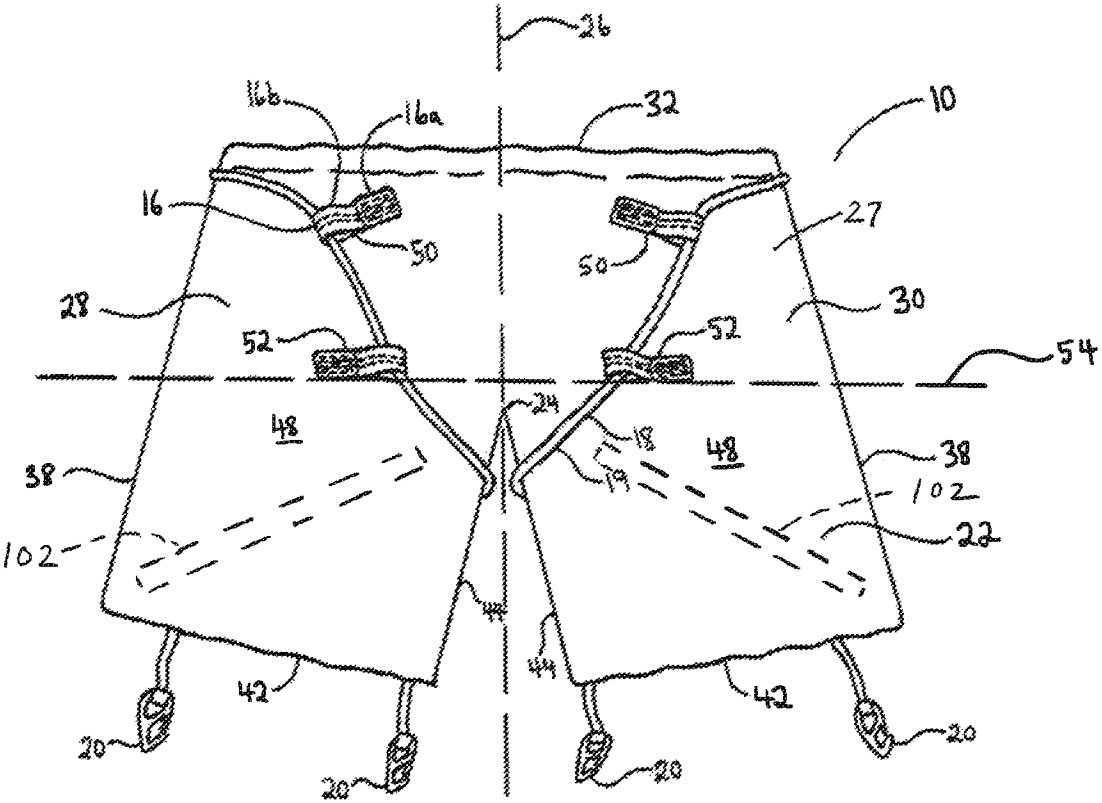
FIG. 2 is a rear view of the training apparatus shown in FIG. 1.

Each loop-forming connector or patch can further comprise a fixed part **16*a* that is attached to the cover. The fixed part is adjacent the looped part, and the looped part is attached to the cover by the fixed part, as shown in FIGS. 1 and 2**. In other embodiments, the looped part can be attached to the cover along the portion of the looped part adjacent the cover, or alternatively, the fixed part can be the portion of the looped part adjacent the cover so that the fixed part forms part of the looped part. In alternate embodiments, the patch is attached to the cover only at its ends, e.g. by reinforced stitching, leaving an unattached segment that, together with the surface of the cover, forms a loop-like opening.

Each patch connector slidably and releasably receives therethrough at least one elongate resistive member 18, by means of the looped part or the loop-like opening. The resistive member in an exemplary embodiment is an elongate flexible tube 19, such as the hollow elastomeric resistance tube depicted in FIGS. 1 to 3 and 6. An exemplary version of the tube 19 is elastic or elastomeric so that it can stretch substantially during use. In alternate embodiments, different resistive devices can be used, e.g. a bungee cord, or similar mechanism for imparting resistance to the movement of a user's legs. Preferably each end of tube 19 has a mechanical fastener 20. The mechanical fastener can be a snap fastener, a clip, or other similar mechanical means for connecting the ends of the tubes to a connecting mechanism arranged on each skate.

In an exemplary embodiment, the cover has an adjustable waistband 12 along a top edge 32 of the cover. The waistband can be manually adjusted by the user and releasably maintained in a desired adjusted position by a buckle 14 attached to one or more straps or belts. Thus the circumference of the waistband is adjustable by means of the buckle 14. Alternatively, the buckle and straps can be replaced by a drawstring that can be tied together at its ends, suspenders, or some other similar mechanism for militating against downward movement of the cover, shorts or pants during use of the training apparatus.

In one embodiment, a front side 34 (shown in FIG. 1) of the cover on each of its left and right sides has fixedly attached to it three connectors or patches: a top outer patch 36 positioned adjacent the top edge and an outer side edge 38 of the leg sleeve with its looped part facing the outer side edge; a bottom outer patch 40 positioned adjacent a bottom edge 42 and the outer side edge of the leg sleeve with its looped part facing an inner side edge 44; and a bottom inner patch 46 positioned adjacent the bottom edge and the inner side edge of the leg sleeve with its looped part facing the inner side edge. In this embodiment, a rear side 48 (shown in FIG. 2) of the cover on each of its left and right sides has fixedly attached to it two connecting patches: a top patch 50 positioned adjacent the top edge and substantially mid-way between the outer side edge and a midline 26 of the cover with its looped part facing the outer side edge and angled about 45 degrees downward from the top edge; and a middle patch 52 positioned below the top patch 50 on a horizontal plane 54 that is slightly higher than a crotch 24 of the cover with its looped part facing the midline. The midline identifies a plane perpendicular to the front of the cover that equally divides the left leg sleeve and the right leg sleeve and the upper tubular section 27 which the two leg sleeves are attached.

Figure 3:
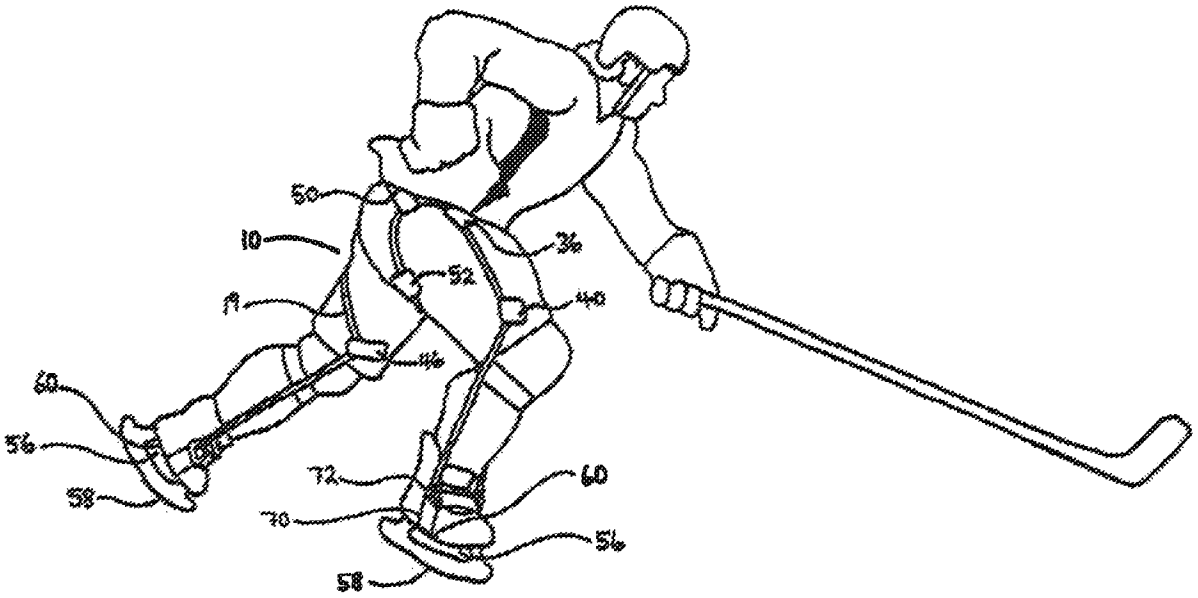
FIG. 3 shows a hockey player wearing the training apparatus shown in FIGS. 1 and 2.
Figure 6:
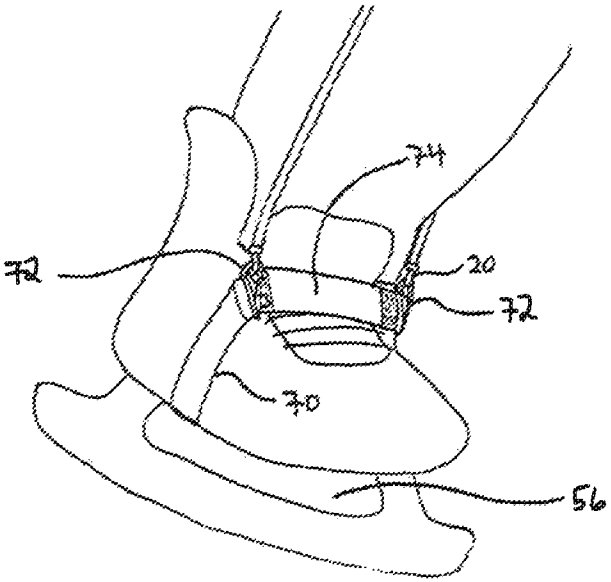
FIG. 6 shows the foot strap of FIG. 4 in use around an ice skate.

For each leg of a user, the user can pass the tube through one or more of the looped parts, and fasten the tube at its ends to the skate or shoe using the mechanical fasteners. If the apparatus is used to train an ice skater, the resistive tube can be connected at its ends to a strap connector that passes through the gap between the skate blade 58 and the bottom of the skate boot 60 as shown in FIGS. 3 and 6. It will be understood that during use of the training apparatus, sections of at least one tube or resistive member can extend along opposite sides of a respective leg of a skater to the skate to which they are attached.

For optimal muscle conditioning and training, using as an example the exemplary embodiment wherein the cover or cover member has fixedly attached thereon the ten patches previously described and depicted in the figures (namely two top outer patches, two bottom outer patches, two bottom inner patches, two top patches 50 (rear side), and two middle patches 52 (rear side)), the user can pass one or more tubes through the looped part of each of said five patches on each of the left and right sides of the cover. This can be accomplished by first passing an end of the tube through the looped part of the bottom inner patch 46, then to the rear side of the cover through the looped part of the middle patch 52, then through the looped part of the top patch 50, then back to the front side through the looped part of the top outer patch 36, and finally through the looped part of the bottom outer patch 40, before fastening the ends of the tube to the aforementioned strap connector 70 secured around the user's skate or shoe. The resistance tube can also be inserted through all five patches on each side of the cover following the reverse path. Once the one or more tubes are inserted through the connectors or patches and fastened at the ends to the skates or footwear of the user using the strap connectors, the user can proceed to engage in activities, such as skating, while benefiting from the resistance offered by the one or more tubes. Because the loop-type connectors are in fixed positions around the user's leg and buttocks, the resistance is optimally applied to key areas for muscular and endurance training while engaging in natural skating motions.

A user of the training apparatus can alter the resistance levels and the muscle groups targeted for resistance training on each leg. For example, a user may decide to pass the tube through only a subset of the looped parts on each of the left and right sides of the cover to concentrate resistance around certain areas of the leg, or not use a tube 19 at all on one side of the cover while using a tube 19 on the other side of the cover, so that one leg can be selectively targeted during training. A user can also substitute a tube for another tube of greater or lesser resistance, or alternatively, pass more than one tube through the looped parts of a leg sleeve to greatly increase resistance. Where more than one tube is used on one of the left and right sides of the cover, ensuring that the combined width of the tubes is less than the diameter of the looped parts facilitates the elongation and contraction of the tube through the looped parts during use of the apparatus.

Through fixedly attaching the connecting patches onto the cover by, for example, reinforced stitching, and further through fastening the ends of the tubes using mechanical fasteners, the training apparatus can avoid the use of Velcro® which may be ill-suited to fixedly hold in place high-resistance resistive members in some applications.

Certain characteristics of the cover and the one or more connecting patches, in some embodiments, can contribute to the efficiency and effectiveness of the training apparatus. For example, where a looped part is used, the looped part of each patch is sized larger than the diameter of the tube, and in most embodiments, the cover is formed from nylon while each patch is formed from nylon webbing. Nylon fibres characteristically are strong and have low friction properties. The tube can therefore contract and expand through the looped parts and over the surface of the cover during use of the training apparatus relatively freely with minimal counter-force or restriction to its movement. In this way, a user is able to relatively accurately gauge the level of resistance applied by the apparatus by reference solely to the one or more resistance tubes used, as other sources of resistance (such as would be created, e.g., by friction from a user's thigh or clothing in the case of a resistance apparatus that does not utilize a minimal friction cover) are effectively minimized in the training apparatus.

Effectiveness and efficiency is further achieved by fixedly attaching the connecting patches in selected fixed positions on the cover, thereby ensuring that the placement of the tube around the muscles used during, e.g. skating, remains relatively stationary and optimal for resistance training (e.g., in the embodiment depicted in the figures, a tube running through all five patches on each half of the cover is ensured to always pass through the points where each of said patches is attached to the cover, even while engaging in skating motions, so that resistance is always maintained around at least the upper leg and buttock, as previously described). The apparatus maintains a bias in the legs to help prevent the legs from straightening during skating, and promotes muscular and endurance development while allowing a user of the apparatus to maintain a natural skating motion.

In some embodiments, the cover is kept from succumbing to the downward force of the resistive members by the adjustable waistband and buckle. By tightening waistband 12 (e.g. over hockey pants or a hockey girdle) and releasably maintaining the waistband in its tightened position using buckle 14 and attached strap(s) or belt, a user can use the apparatus without experiencing loss of resistance from the resistance tubes as a result of downward movement of the cover. This further contributes to the efficiency and effectiveness of the apparatus as a means for providing resistance during training.

In alternate embodiments, the connecting patches can be releasably attached to the cover, such as by snap fasteners or buttons, so that the patches can be removed from the cover, oriented into a new position, and reattached to the cover, in order to target different muscle groups. It will be appreciated that versions of the described training apparatus(s) could be used to provide resistance training while engaging in activities other than ice skating, such as, e.g., walking, running, jumping, or swimming.

Figure 4:
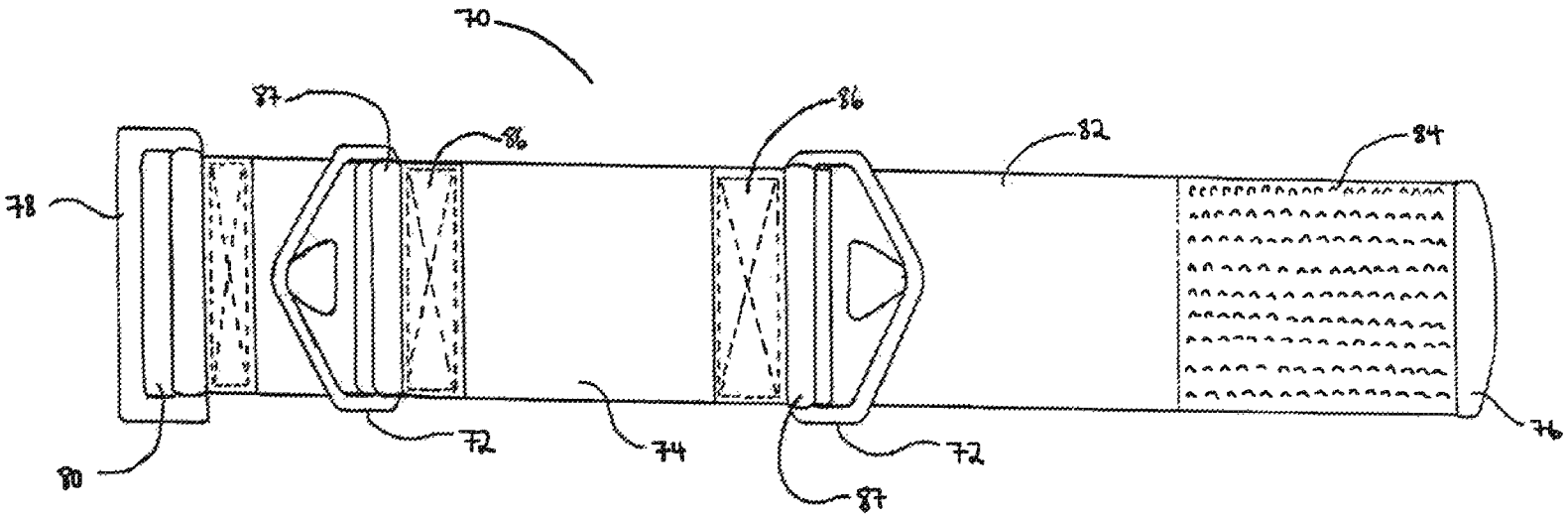
FIG. 4 shows a foot strap for attaching the training apparatus to a skate or shoe.
Figure 5:
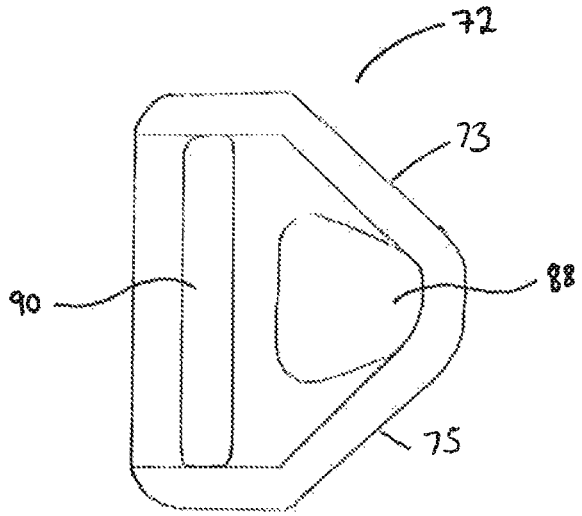
FIG. 5 shows a clip receiving member of the foot strap of FIG. 4.

Referring to FIGS. 4 through 6, the flexible tubing 19 can be releasably attached at its ends to a user's shoe or skate by one or more receiving members 72 attached to a foot strap connector 70. Thus, each of the mechanical fasteners 20 of the tubing 19 is releasably attached to a respective one of receiving members 72 attached to the foot strap 70 by, e.g., nylon webbing patches 86 forming webbing loops 87 passing through a webbing slot 90 of the receiving member. In the illustrated embodiment, the foot strap connector has two receiving members, each receiving a mechanical fastener 20 connected to one end of the tubing 19. Each of the receiving members 72 can be arranged on a respective side of the user's foot, as shown in FIG. 6. It is expected that in most cases the foot strap 70 is comprised of nylon, although other materials of similar strength can be used. One exemplary version of the foot strap connector has a strap width of 1.5 inches which enables the connector to have a good hold on the skate or other footwear.

Referring to FIG. 4, in some embodiments, the strap has a Velcro® hook 82-and-loop 84 arrangement, a pull tab 76 at an end of the strap adjacent the hook-and-loop arrangement 82, 84, and a rigid plastic or metal loop 78 at an opposite end of the strap 70 for receiving therein the pull tab 76 and a portion of at least the looped part 84 of the hook-and-loop arrangement 82, 84. The pull tab 76 can be constructed from a rigid material, such as a hard plastic, or can be formed from layers of nylon or nylon webbing so that it has a greater thickness and strength. In some embodiments, the pull tab 76 can be omitted.

Where two receiving members 72 are used, a user of the training apparatus 10 would position the foot spanning section 74 over top of his or her foot (e.g. over a shoe or skate), so that each receiving member 72 is positioned generally on right and left sides of his or her foot, pass the pull tab 76 (or the loop part 84, depending on the embodiment) under the foot (or where used with a skate, through gap 56) and through slot 80 of the loop 78 until the strap 70 is snug around the foot, and engage Velcro® loops with Velcro® hooks to releasably secure the strap around the user's foot. Each mechanical fastener 20 on an end of tubing 19 can then be releasably secured in opening 88 of a respective one of the receiving members on one side of the user's foot, as shown in FIG. 6. The foot strap connector provides a secure device for releasably attaching the mechanical fasteners 20 of the tubing 19. In most embodiments, the receiving members 72 are each formed as a unitary piece, typically from a strong, rigid material such as a metal alloy or hard plastic. This illustrated five-sided receiving member 72 has two sloping sides 73, 75 on opposite sides of the opening 88. Because the sides 73, 75 are straight, this helps in the attachment of the fasteners 20 which are strapped onto the receiving member.

Although Velcro® can be one means for releasably securing the ends of the foot strap connector together, other means can be used, e.g. snap fasteners, clips or hooks.

In one exemplary form of the present training apparatus 10, the cover can be provided with rubber or rubberlike friction strips 100, 102 on the front and/or rear side as shown in FIGS. 1 and 2. These can run at an acute angle to the horizontal plane 54 as shown. The thin strips 100, 102 can have a width of about one inch along their length and they can be attached by sewing to the inside surface of the cover. These strips can help to reduce relative movement between the cover and the underlying pants and help to prevent downward movement of the cover during use of the apparatus.

Figure 7:
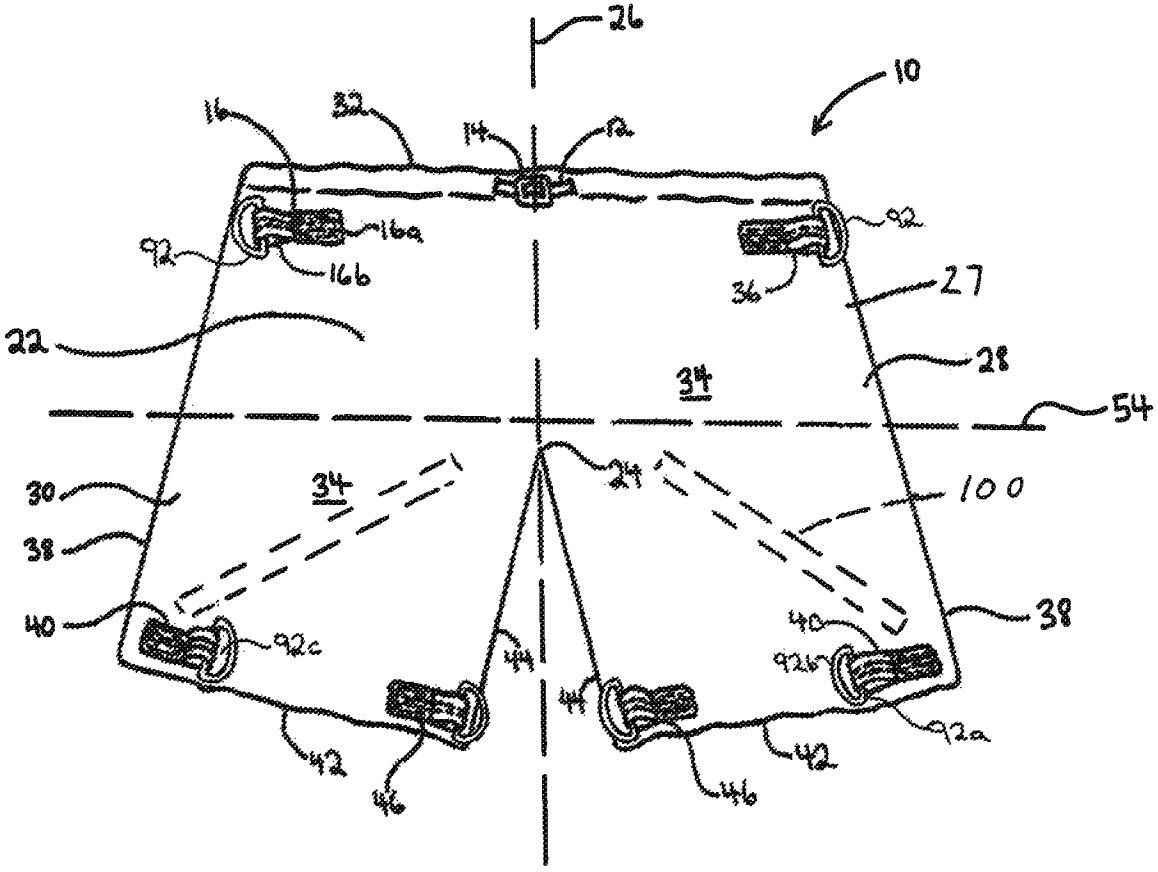
FIG. 7 is a front view of an alternate embodiment of the training apparatus.

Referring to FIG. 7, in a further embodiment, the one or more connectors may each comprise or include a rigid ring or ring-like structure 92, which may be comprised of a D-ring. Where used as described in the embodiments discussed above, each ring may pass through looped part 16*b* (as shown in FIG. 7) or the loop-like opening. The rings may alternatively be secured to cover 22 using other means of fastening or other fasteners. For example, where the ring is in the form of a D-ring (as in the embodiment of FIG. 7) the flattened side 92*a* of each D-ring may be disposed beneath cover 22 to thereby be secured to training apparatus 10, with the rounded portion 92*b* of the D-ring protruding to the exterior of the training apparatus.

Where rings 92 are used, each connector slidably and releasably receives at least one elongate resistive member 18 through ring opening 92*c* (for clarity, the resistive members have not been shown in FIG. 7). Rings 92 preferably have a smooth or relatively low-friction surface that facilitates the passage and movement of the resistive members through opening 92*c*. It will be appreciated that a wide variety of rings or ring-like structures could be utilized. Such structures include, but are not limited to, D-rings, circular rings, square or rectangular-shaped rings, and grommets. Further, while in most cases it is expected that the rings will be metallic, they may alternately be formed from other rigid materials, including plastic, fibreglass, and carbon fiber.

It is to be understood that what has been described are exemplary embodiments of the invention. The scope of the claims should not be limited by the embodiments set forth above, but should be given the broadest interpretation consistent with the description as a whole.

The invention claimed is:

1. A training apparatus for a skater comprising:

a flexible fabric cover having a front, a back, a top end, and a bottom end, said cover including a main body section and left and right leg sections extending from and connected to said main body section and capable of covering at least an upper portion of the skater's legs, loop-forming connectors mounted on both the front and the back of said cover, said connectors including upper connectors mounted on the front and back of said main body section and lower connectors mounted on the front of both the left and right leg sections, said connectors forming a loop; and elongate elastomeric resistive members having a first end and a second end attachable to said cover by said loops formed by said connectors, said resistive members longitudinally slidable through said connectors, at least one of said resistive members being mounted on a left half of the cover and at least one of said resistive members being mounted on a right half of the cover, each resistive member positionable to extend along opposite sides of a leg of the skater, said first end and said second end of each resistive member is attached to a respective skate.

2. The training apparatus of claim 1, wherein each loop-forming connector is a fabric patch with a D-ring secured thereto, said D-ring forming a loop and each connector slidably and releasably receiving one of the at least one resistive members through said loop of said D-ring.

3. The training apparatus of claim 2, wherein each of the at least one of said resistive members is a stretchable tube member having a mechanical fastener secured to said first end and said second end for attaching said resistive members to said respective skate.

4. The training apparatus of claim 1, wherein said connectors are fabric patches, and the loop formed by each connector slidably and releasably receives one of the at least one resistive members.

5. The training apparatus of claim 1, wherein said cover is made of nylon fabric and is sized to fit over pants.

6. The training apparatus of claim 1 further comprising at least one strap connector connectible to one of the at least one resistive members and to said respective skate.

* * * * *